US009845566B2

(12) United States Patent
Heo et al.

(10) Patent No.: US 9,845,566 B2
(45) Date of Patent: Dec. 19, 2017

(54) CLOTHES TREATING APPARATUS WITH HEAT RECOVERY DEVICE

(71) Applicant: LG Electronics Inc., Seoul (KR)

(72) Inventors: Seonil Heo, Seoul (KR); Myoungjong Kim, Seoul (KR); Junseok Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 711 days.

(21) Appl. No.: 14/264,218

(22) Filed: Apr. 29, 2014

(65) Prior Publication Data

US 2014/0317946 A1 Oct. 30, 2014

(30) Foreign Application Priority Data

Apr. 30, 2013 (KR) ..... 10-2013-0048613

(51) Int. Cl.
*F26B 21/06* (2006.01)
*D06F 58/02* (2006.01)
(Continued)

(52) U.S. Cl.
CPC ..... *D06F 58/02* (2013.01); *D06F 58/20* (2013.01); *D06F 58/24* (2013.01)

(58) Field of Classification Search
CPC ..... D06F 58/10; D06F 58/24; D06F 58/206; D06F 58/02; D06F 58/20; F26B 11/02;
(Continued)

(56) References Cited

U.S. PATENT DOCUMENTS 4,270,282 A * 6/1981 Lotz ..... D06F 58/02 165/10
2004/0098878 A1* 5/2004 Park ..... D06F 58/24 34/595
(Continued)

FOREIGN PATENT DOCUMENTS

CN 1502742 6/2004
CN 102686792 9/2012
(Continued)

OTHER PUBLICATIONS

European Search Report dated Sep. 22, 2014 for European Application No. 14166465.6, 9 pages.
(Continued)

*Primary Examiner* — John McCormack
(74) *Attorney, Agent, or Firm* — Fish & Richardson P.C.

(57) ABSTRACT

A clothes treating apparatus includes a cabinet and a drum rotatably installed within the cabinet. The clothes treating apparatus also includes a circulation flow path in which exhaust air discharged from the drum is re-supplied to the drum and a condenser configured to allow the exhaust air and cooling air introduced from an outside of the cabinet to be heat-exchanged. The clothes treating apparatus further includes a cooling flow path configured to guide the cooling air toward the condenser and a blowing fan configured to introduce air from outside of the cabinet to an interior of the cooling flow path. In addition, the clothes treating apparatus includes a discharge opening that discharges cooling air, which has passed through the condenser, to an interior of the cabinet. The rotational shaft of the drum is disposed between the discharge opening and the blowing fan.

18 Claims, 8 Drawing Sheets

(51) Int. Cl.
*D06F 58/20* (2006.01)
*D06F 58/24* (2006.01)

(58) Field of Classification Search
CPC ..... F26B 25/06; F26B 21/086; F26B 5/04; F26B 5/06; F26B 23/001
USPC ..... 34/595, 134, 603, 604, 86, 77, 513, 73, 34/76, 131, 219, 468, 477, 514, 515, 449, 34/469
See application file for complete search history.

(56) References Cited

U.S. PATENT DOCUMENTS

2008/0189974 A1* 8/2008 Dittmer ..... D06F 58/20 34/132
2009/0071031 A1* 3/2009 Kim ..... D06F 58/24 34/140
2010/0058605 A1* 3/2010 Kang ..... D06F 58/24 34/85
2014/0165416 A1* 6/2014 Pillot ..... D06F 58/04 34/82

FOREIGN PATENT DOCUMENTS

EP 1 426 480 A2 6/2004
EP 2 270 274 A1 1/2011
EP 2 395 145 A1 12/2011
EP 2 471 998 A1 7/2012
JP 2007143720 A * 6/2007 ..... D06F 58/206

OTHER PUBLICATIONS

Office Action issued in Chinese Application No. 201410155988.9 dated Nov. 4, 2015, 7 pages.

* cited by examiner

CLOTHES TREATING APPARATUS WITH HEAT RECOVERY DEVICE

CROSS-REFERENCE TO RELATED APPLICATION

Pursuant to 35 U.S.C. §119(a), this application claims the benefit of earlier filing date and right of priority to Korean Application No. 10-2013-0048613, filed on Apr. 30, 2013, the content of which is incorporated by reference herein in its entirety.

FIELD

The present disclosure relates to a clothes treating apparatus with a heat recovery device, and for example, to a clothes treating apparatus having a unit for utilizing thermal energy of hot air discharged from a drum.

BACKGROUND

In general, a clothes treating apparatus having a drying function, such as a dryer, is an apparatus that blows hot air generated by a heater to the interior of a drum to absorb moisture of a drying target to perform drying on the target. A clothes treating apparatus may be classified into an exhaust-type dryer and a circulation-type dryer depending on a method of processing moist air generated when a target is dried by absorbing moisture thereof.

The exhaust-type dryer uses a method of discharging moist air from a drum to the outside, and to this end, the exhaust-type dryer requires an exhaust duct for discharging high temperature moist air containing moisture evaporated within a drum to the outside. In this case, a gas may be used as a heat source and carbon monoxide, or a similar combustion product, is also discharged, and thus, the exhaust duct needs to reach an outdoor area. A circulation-type dryer uses a method of condensing moist air discharged from a drum by a heat-exchanger to remove moisture, and transferring moisture-removed dry air to the drum to re-circulate air.

As for configuration, a circulation-type clothes dryer may include a body, a drum rotatably installed within the drum, a circulation duct having both ends connected to the drum to form a flow path along which air is circulated, a heater installed within the circulation duct to heat air, a blowing fan forcibly circulating air, and the like. The circulation-type clothes dryer further may include a heat-exchanger or a condenser removing moisture included in air discharged from the drum.

The condenser may be structured for heat-exchanging air or a coolant introduced from the outside of a dryer with air discharged from a drum to reduce a temperature and humidity of exhaust air sufficient to be re-supplied to the interior of the drum. As the condenser, a water cooling-type condenser using a coolant supplied from an external water source or an air cooling-type condenser using ambient air may be used. When using an air cooling-type heat-exchanger, cooling air heated through heat exchanging with exhaust air is discharged to the outside of a body.

In some cases, in order to reduce energy consumed during a drying process, thermal energy generated by a heater is used only for drying clothes as much as possible. To this end, a heat pump may be used to heat hot air supplied to a drum with thermal energy of air discharged from the drum, or a behavior of a drum may be controlled to allow hot air to come into contact with clothes evenly during a drying process.

SUMMARY

In one aspect, a clothes treating apparatus includes a cabinet, a drum located within the cabinet and configured to rotate about a rotational shaft, and a circulation duct that defines a circulation flow path in which exhaust air discharged from the drum is re-supplied to the drum. The clothes treating apparatus also includes a condenser configured to allow the exhaust air and cooling air introduced from outside of the cabinet to be heat-exchanged and a blowing duct configured to guide the cooling air toward the condenser. The clothes treating apparatus further includes a blowing fan configured to introduce air from outside of the cabinet to an interior of the cooling flow path and a discharge opening that discharges cooling air, which has passed through the condenser, to an interior of the cabinet. The rotational shaft of the drum is disposed between the discharge opening and the blowing fan.

Implementations may include one or more of the following features. For example, the discharge opening may discharge the cooling air toward the drum. In this example, the condenser may be located on a bottom surface of the cabinet.

In addition, the cabinet may include an air vent for discharging, from the cabinet, cooling air discharged from the discharge opening into the cabinet. Also, a partial amount of cooling air which has passed through the condenser may be discharged to the interior of the cabinet through the discharge opening, and a remaining amount of cooling air may be directly discharged to the outside of the cabinet.

In some implementations, the clothes treating apparatus may include a guide member arranged in the discharge opening and configured to guide cooling air discharged from the discharge opening. In these implementations, the guide member may include a fastening portion fastened to an outer circumferential portion of the discharge opening and a discharge guide portion configured to guide a direction in which cooling air is discharged from the discharge opening.

The discharge guide portion may direct cooling air discharged from the discharge opening toward the drum. The discharge guide portion may direct cooling air discharged from the discharge opening perpendicular to the rotational shaft of the drum at a bottom of the drum. The guide member may include a hook portion located at one end portion thereof. The hook portion may couple to a hook coupling portion that is located proximate to the discharge opening.

In another aspect, a clothes treating apparatus includes a cabinet, a drum located within the cabinet and configured to rotate about a rotational shaft, and a base that is located on a bottom surface of the cabinet, that defines a circulation flow path that guides air discharged from the drum back to the drum, and that defines a cooling flow path that crosses the circulation flow path. The clothes treating apparatus also includes a condenser that is located at an intersection between the circulation flow path and the cooling flow path and that allows cooling air from the cooling flow path and exhaust air from the circulation flow path to be heat-exchanged. The clothes treating apparatus further includes a blowing fan configured to introduce cooling air to an interior of the cooling flow path and a discharge opening that discharges cooling air, which has passed through the condenser and the cooling flow path, to an interior of the cabinet. The rotational shaft of the drum is disposed between the discharge opening and the blowing fan.

Implementations may include one or more of the following features. For example, the clothes treating apparatus may include a base cover located above the base and defining at least a portion of the cooling flow path and at least a portion of the circulation flow path. In this example, the discharge opening may be defined in the base cover.

In some implementations, the clothes treating apparatus may include a guide member arranged in the discharge opening and configured to guide cooling air discharged from the discharge opening. In these implementations, the guide member may include a fastening portion fastened to an outer circumferential portion of the discharge opening and a discharge guide portion configured to guide a direction in which cooling air is discharged from the discharge opening.

The discharge guide portion may direct cooling air discharged from the discharge opening toward the drum. The discharge guide portion may direct cooling air discharged from the discharge opening along a surface of the base cover. The guide member may include a hook portion located at one end portion thereof and the base cover may include a hook coupling portion that is located proximate to the discharge opening and that is configured to couple to the hook portion of the guide member.

In some examples, a partial amount of cooling air which has passed through the condenser may be discharged to the interior of the cabinet, and a remaining portion of cooling air may be directly discharged to the outside of the cabinet. In these examples, the clothes treating apparatus may include an auxiliary discharge portion that communicates with the cooling flow path, that discharges the remaining portion of cooling air to the outside of the cabinet, and that is located at a front surface of the base.

Further scope of applicability of the present application will become more apparent from the detailed description given hereinafter. However, it should be understood that the detailed description and specific examples are given by way of illustration only, since various changes and modifications within the spirit and scope of the disclosure will become apparent to those skilled in the art from the detailed description.

DETAILED DESCRIPTION

Figure 1:
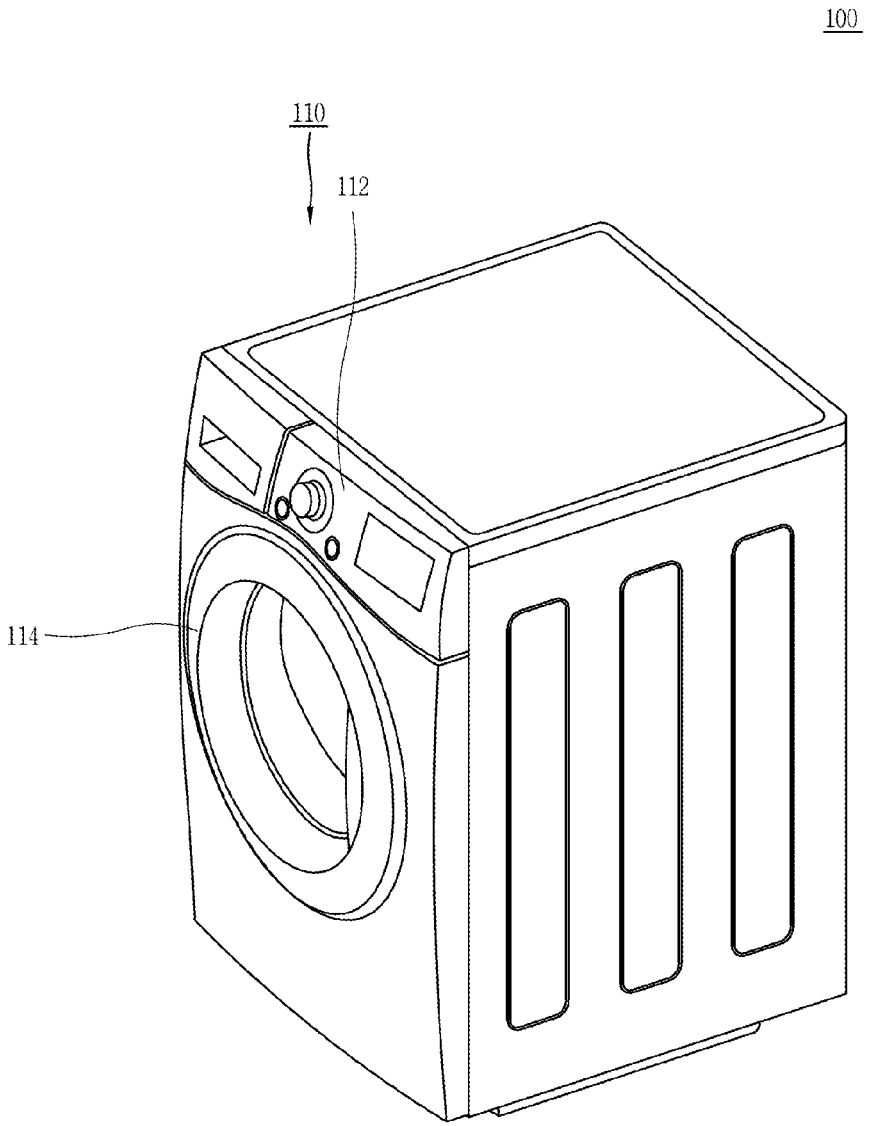
FIG. 1 is a perspective view illustrating a first example of a clothes treating apparatus according to the present disclosure.
Figure 2:
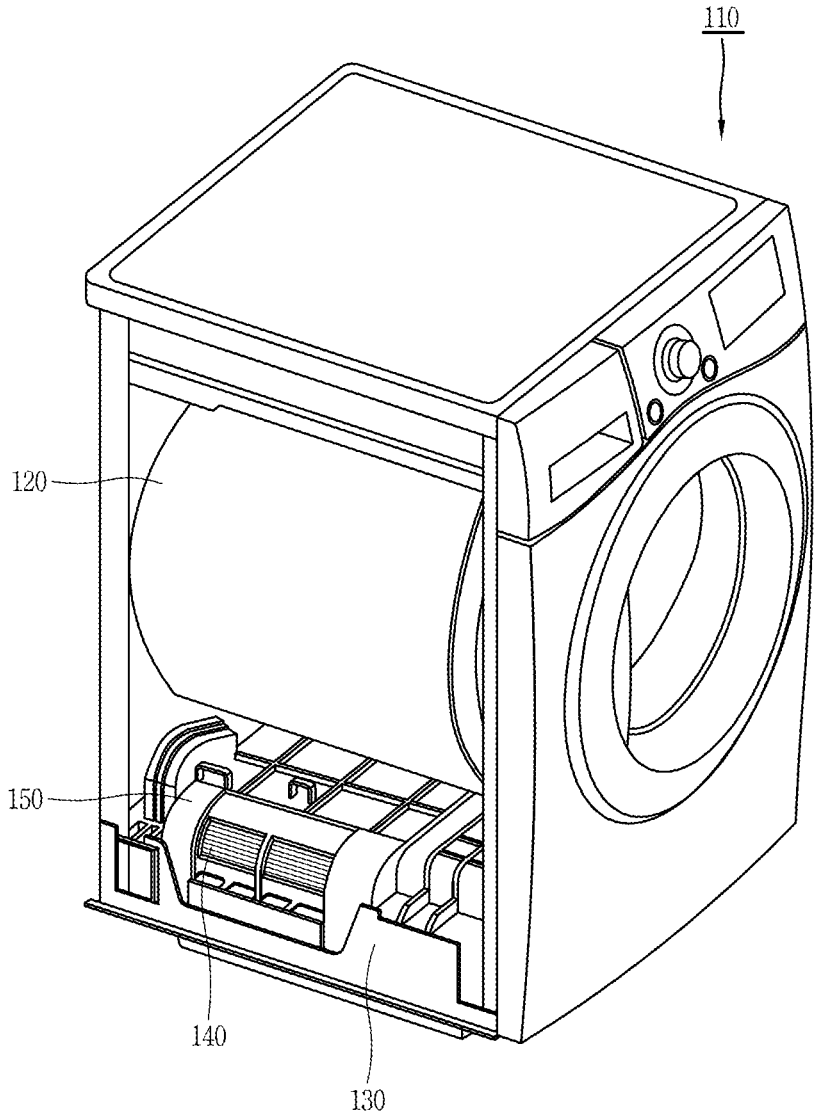
FIG. 2 is a perspective view illustrating a state in which a side panel is removed in the first example illustrated in FIG. 1.

FIG. 1 illustrates a first example of a clothes treating apparatus according to the present disclosure, and FIG. 2 illustrates a state in which a side panel is removed in the example illustrated in FIG. 1. Referring to FIGS. 1 and 2, a clothes dryer 100 includes a cabinet 110 constituting the exterior and a drum 120 rotatably provided within the cabinet 110.

A control panel 112 is provided in an upper portion of a front surface of the cabinet 110 to control functions of the dryer and display an operational state. A door 114 is installed in a lower side of the control panel 112 to open and close an entrance communicating with the drum 120.

A base 130 is installed on the bottom within the cabinet 110. The base 130 provides an area in which various components are installed within the cabinet 110, and forms a circulation path and a cooling path as described below.

Figure 3:
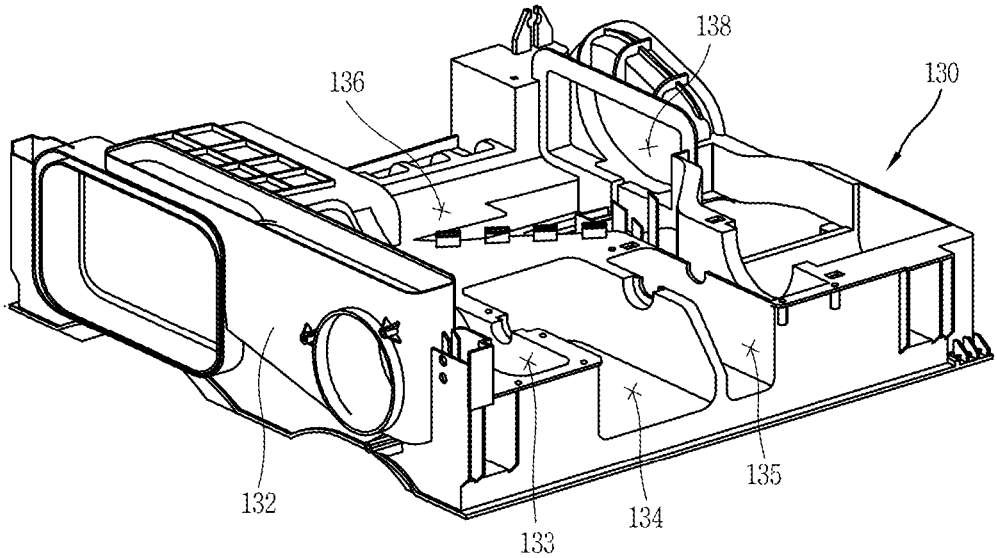
FIG. 3 is a perspective view illustrating a base provided in the first example illustrated in FIG. 1.
Figure 4:
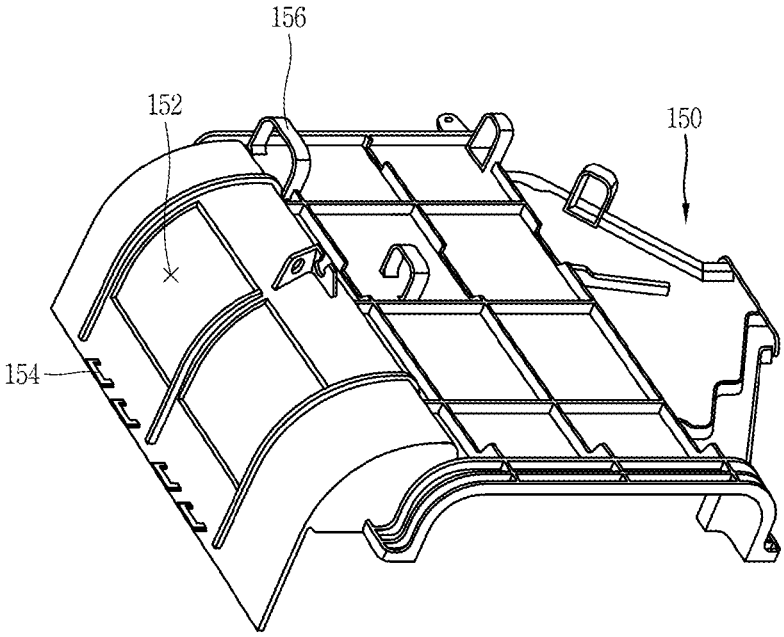
FIG. 4 is a perspective view illustrating a base cover provided in the first example illustrated in FIG. 1.
Figure 5:
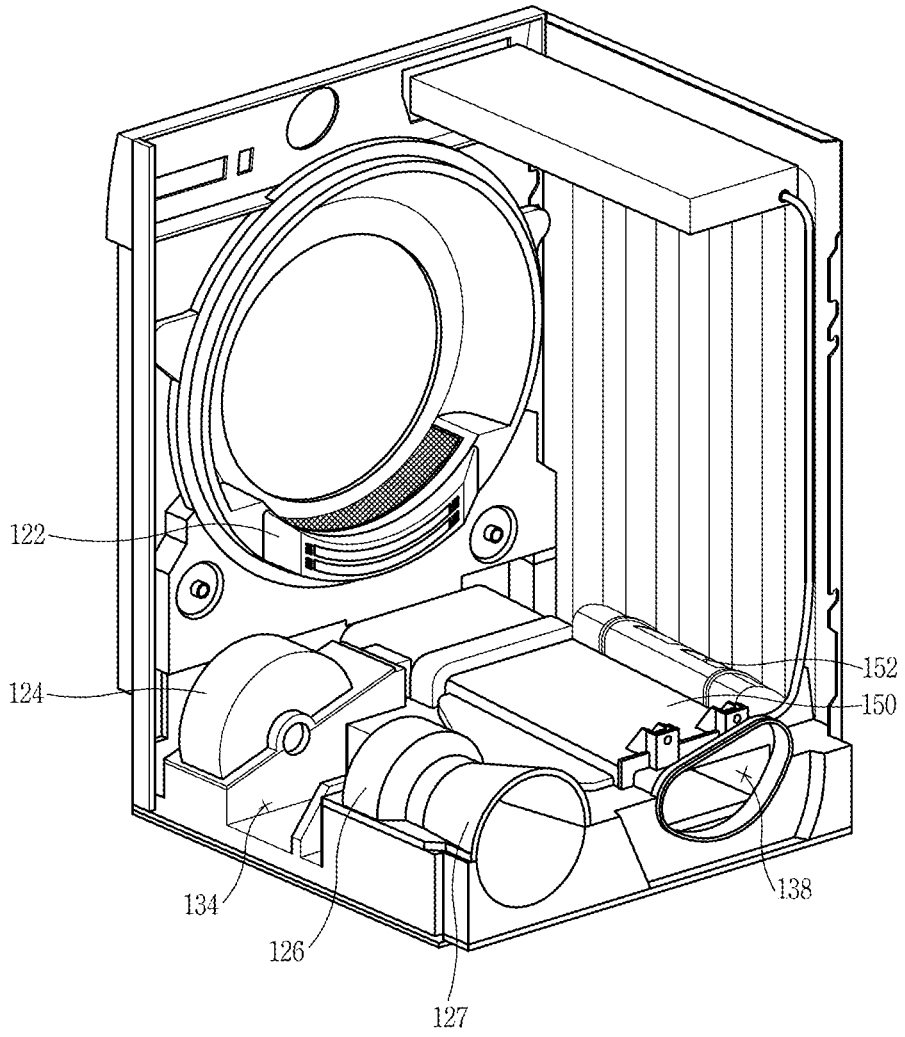
FIG. 5 is a view illustrating an internal structure illustrating an air flow in the first example.

Hereinafter, an internal structure of the first example will be described. FIG. 3 illustrates a base provided in the example illustrated in FIG. 1, FIG. 4 illustrates a base cover provided in the example illustrated in FIG. 1, and FIG. 5 illustrates an internal structure showing an air flow in the first example. Referring to FIGS. 3 through 5, a lint filter 122 is installed in the vicinity of the door 114. The lint filter 122 serves to remove lint included in air having a high temperature discharged from the drum 120 and guide exhaust air toward a circulation flow path as described hereinafter.

The base 130 includes a filter installation part 132 in which the lint filter 122 is installed. A fan installation portion 133 is formed on a rear surface of the filter installation part 132, and a circulation blowing fan 124 is disposed in the fan installation portion 133 and sucks air within the drum 120 to guide the air toward the circulation flow path. A circulation flow path part 136 is formed on the side of the fan installation portion 133 and forms a circulation flow path along which exhaust air discharged from the circulation blowing fan 124 is re-supplied to the interior of the drum.

As illustrated in FIG. 2, a heat exchanger 140 as a condensing unit is installed within the circulation flow path part 136, and exhaust air introduced to the circulation flow path part 136 passes through the heat exchanger 140 and is subsequently re-supplied to the interior of the drum. In addition, an upper surface of the circulation flow part 136 is opened, and a base cover 150 is installed in the open upper surface to form a circulation flow path. The base cover will be described in more detail hereinafter.

Apart from the circulation blowing fan 124, a cooling blowing fan 126 is installed in the base 130 to suck cooling air from the outside of the cabinet to supply the same toward the heat exchanger. A hood 127 is installed in an inflow side of the cooling blowing fan 126 to allow ambient air outside of the cabinet to be introduced. The hood 127 is fixedly installed in the base 130. The cooling blowing fan 126 is disposed in a cooling fan installation part 135 provided in the base 130.

The cooling fan installation part 135 forms a portion of a cooling flow path along which cooling air is introduced, and cooling air discharged from the cooling blowing fan 126 moves toward the circulation flow path part 136. Thus, the heat exchanger 140 is disposed in an intersection between the circulation flow path and the cooling flow path to allow exhaust air and cooling air to be heat-exchanged. Here, the exhaust air and the cooling air transmit heat through a surface of the heat exchanger 140, but may not be mixed with each other or may not be in contact with each other. Also, a space denoted by reference numeral 134 is a space for installation of a driving motor for driving the circulation blowing fan and the cooling blowing fan.

Referring to FIG. 4, the base cover 150 is formed to cover an upper portion of the circulation flow path part 136, and one end portion (the right side based on FIG. 4) of the base cover 150 is connected to a discharge opening of the cooling blowing fan 126 and the other end thereof covers the side of the heat exchanger 140. Two discharge openings 152 are formed to be adjacent to the other end portion of the base cover 150. The discharge openings 152 serve to discharge cooling air, which has passed though the heat exchanger 140, to the interior of the cabinet, and the discharged cooling air comes into contact with the drum positioned above the discharge openings 152.

Here, a partial amount of the cooling air is discharged through the discharge openings, and the other remaining partial amount of the cooling air is directly discharged to the outside of the cabinet. To this end, an auxiliary discharge portion 138 is formed in a lower portion of the front side of the base 150. The auxiliary discharge portion 138 forms a discharge opening allowing a partial amount of the cooling air to be discharged therethrough together with a bottom surface of the cabinet.

A ring 156 is formed in an upper surface of the base cover 150 in order to fix various hoses, wirings, and the like, disposed within the cabinet.

Hereinafter, operation of the first example will be described.

When drying operation starts, hot air having a high temperature is supplied to the interior of the drum by a heater, and the supplied hot air is brought into contact with the laundry within the drum to dry the laundry. Thereafter, exhaust air having a high temperature and containing moisture is discharged from the drum and introduced into the lint filter 122. Such a flow of exhaust air is incited by the circulation blowing fan 124 as mentioned above.

Exhaust air, which has passed through the lint filter 122, passes through the circulation blowing fan and is introduced to the circulation flow path formed by the circulation flow path part and the base cover. As mentioned above, ambient air is introduced to the cooling blowing fan through the hood and transferred to the heat exchanger. Thus, as hot and humid exhaust air passes through the heat exchanger, temperature and humidity of the air may be lowered, and the air having low temperature and humidity may be heated by the heater and re-supplied to the drum. In addition, cooling air is increased in temperature due to thermal energy transmitted from the exhaust air, and the cooling air having the increased temperature is discharged to the interior of the cabinet through the discharge opening.

In this case, the cooling air moves to the drum above the discharge opening. In some implementations, a surface temperature of the drum is approximately 40 degrees, and the discharged cooling air has a temperature of approximately 50 degrees. Thus, when the cooling air comes into contact with the drum, the surface of the drum may be heated, and accordingly, energy consumption required for generating hot air may be reduced. In addition, since heated cooling air remains within the cabinet, the interior of the cabinet may be maintained at a high temperature. Thus, heat loss through a surface of the cabinet may be minimized. Namely, the cooling air serves to insulate the drum or reserve heat of the drum.

In some examples, the discharge opening is positioned in the opposite side of the motor based on a rotational shaft of the drum. Namely, the rotational shaft of the drum is positioned between the discharge opening and the motor. Thus, discharged cooling air may transmit heat to the drum over other components, whereby the effect of heating of the drum and reserving heat of the drum may be maximized.

Further, cooling air discharged to the interior of the cabinet may be discharged to the outside through an air vent formed in a rear surface of the cabinet.

According to circumstances, a guide member may be installed in the discharge opening to set a direction of discharged cooling air to a desired direction.

Figure 6:
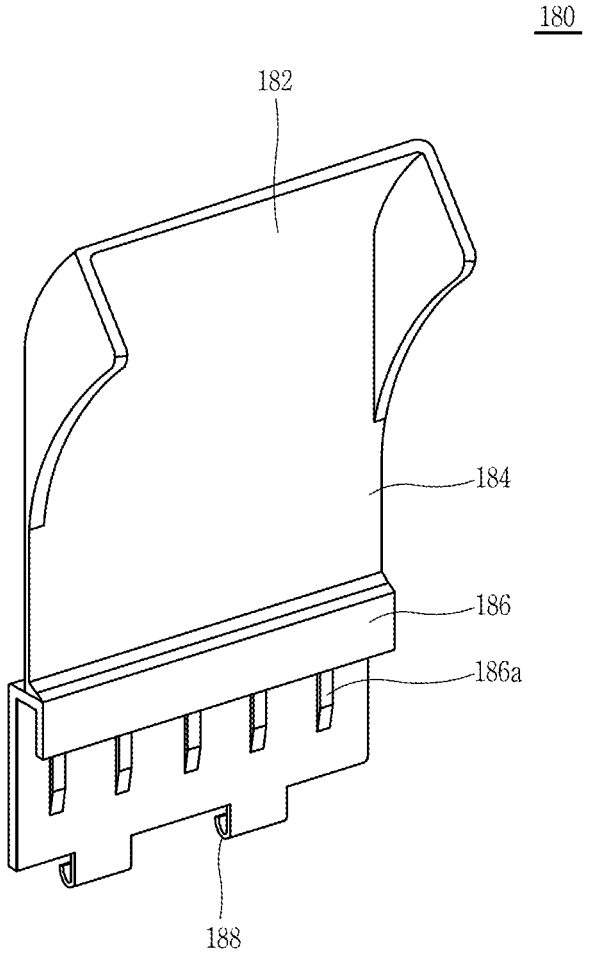
FIG. 6 is a perspective view illustrating an example discharge guide provided in a second example of a clothes treating apparatus according to the present disclosure.

FIG. 6 illustrates an example of the guide member. Referring to FIG. 6, a guide member 180 includes a discharge guide portion 182 bent to have an angle corresponding to a direction in which cooling air is discharged, and a stop portion 186 to be fastened to the discharge opening is formed near a lower end portion of a body portion 184. The stop portion 186 includes a recess allowing an outer circumferential portion of the opening to be inserted therein, and for stable fastening, a plurality of bead portions **186*a* are formed below the stop portion 186**.

The bead portions **186*a* press portions around the discharge opening to prevent the stop portion 186** from being easily released.

Figure 7:
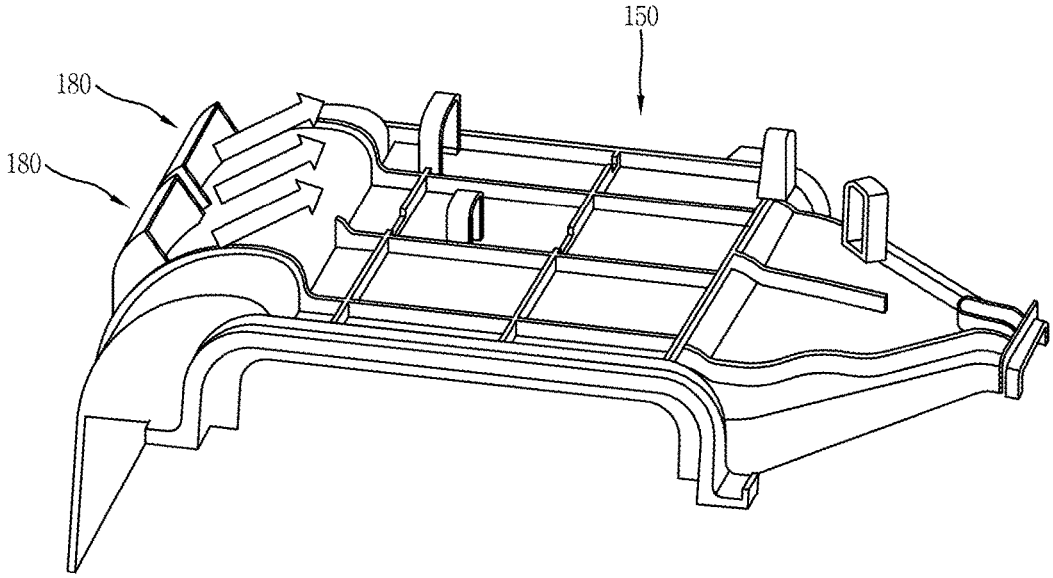
FIG. 7 is a perspective view illustrating a state in which a discharge guide illustrated in FIG. 6 is installed in a base cover.

Also, hooks 188 are formed in a lower end of the body portion 184. The hooks 188 are inserted into hook coupling portions 154 illustrated in FIG. 4 to firmly fasten the guide member together with the stop portion 186. FIG. 7 illustrates a state in which the guide member 180 is fastened to the base cover 150. In FIG. 7, the discharge guide portion is disposed at an angle of approximately 45 degrees with respect to the bottom surface of the cabinet, and thus, discharged cooling air is discharged in the direction indicated by the arrows.

Since the cooling air is discharged toward the drum, thermal energy of the cooling air may be transmitted to the drum.

Figure 8:
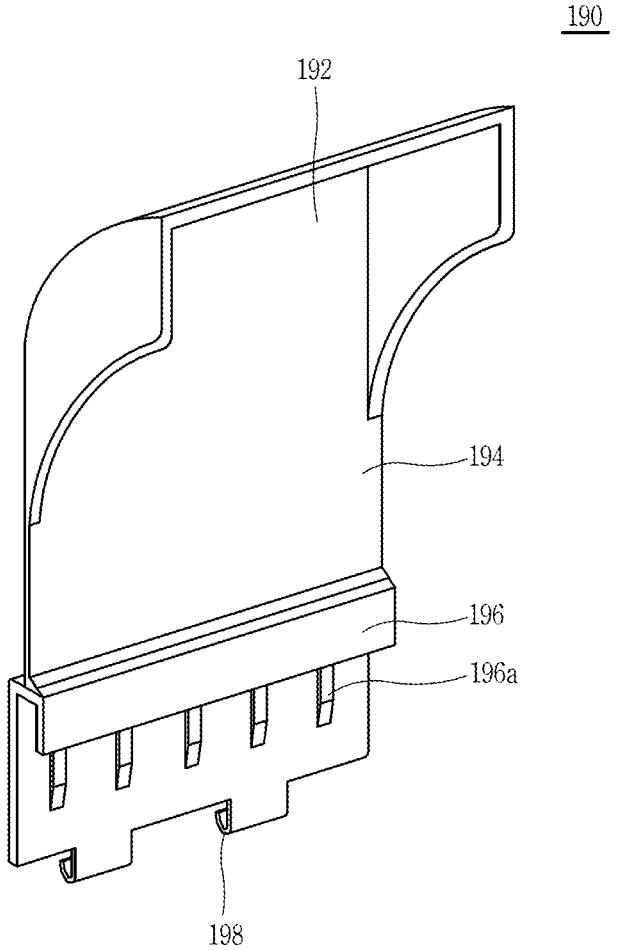
FIG. 8 is a perspective view illustrating a modified example of the discharge guide illustrated in FIG. 6.

In some examples, a discharge angle of the discharge guide portion may be randomly set. Namely, a guide member 190 illustrated in FIG. 8 may have a discharge guide portion 192 disposed in a direction substantially perpendicular to the body portion 194. The guide member 190 illustrated in FIG. 8 also includes a stop portion 196, bead portions **196*a*, and hook portions 198**.

Figure 9:
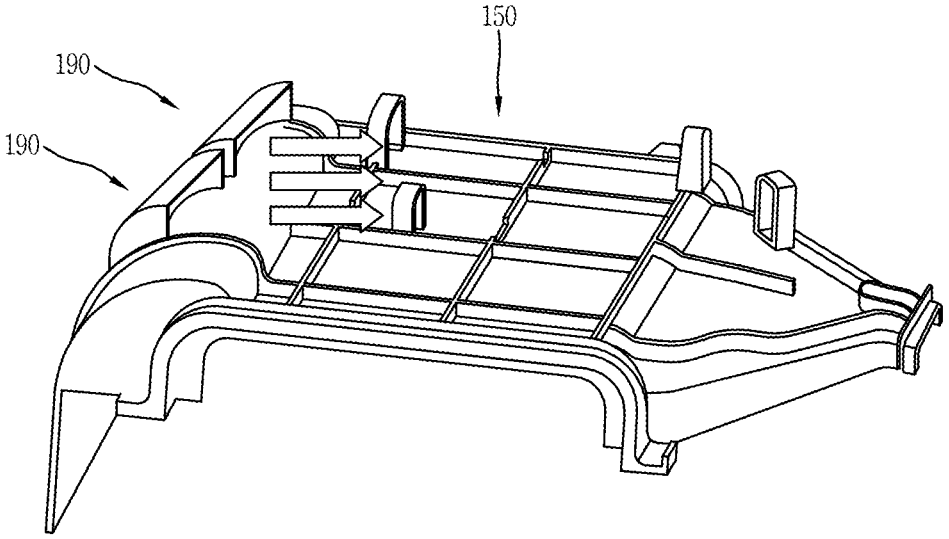
FIG. 9 is a perspective view illustrating a state in which the discharge guide illustrated in FIG. 8 is installed in a base cover.

Referring to FIG. 9, cooling air is discharged substantially parallel along a surface of the base cover. Because hot air rises due to a density difference, cooling air discharged in parallel rises, and thus, the air may evenly come into contact with a lower portion of the drum. Thus, the drum may be evenly heated.

The foregoing examples and advantages are merely exemplary and are not to be considered as limiting the present disclosure. The present disclosure can be readily applied to other types of apparatuses. This description is intended to be illustrative, and not to limit the scope of the claims. Alternatives, modifications, and variations will be apparent to those skilled in the art. The features, structures, methods, and other characteristics of the examples described herein may be combined in various ways to obtain additional and/or alternative implementations.

As the present features may be embodied in several forms without departing from the characteristics thereof, the above-described examples are not limited by any of the details of the foregoing description, unless otherwise specified, but rather should be considered broadly within its scope as defined in the appended claims, and therefore changes and modifications that fall within the metes and bounds of the claims, or equivalents of such metes and bounds, are therefore intended to be embraced by the appended claims.

What is claimed is:

1. A clothes treating apparatus comprising:

a cabinet;

a drum located within the cabinet and configured to rotate about a rotational shaft;

a base that is located on a bottom surface of the cabinet, that defines a circulation flow path that guides air discharged from the drum back to the drum, and that defines a cooling flow path that crosses the circulation flow path;

a condenser that is located at an intersection between the circulation flow path and the cooling flow path and that allows cooling air from the cooling flow path and exhaust air from the circulation flow path to be heat-exchanged;

a blowing fan configured to introduce cooling air to an interior of the cooling flow path; and a discharge opening that discharges cooling air, which has passed through the condenser and the cooling flow path, to an interior of the cabinet, wherein the discharge opening discharges the cooling air toward the drum.

2. The clothes treating apparatus of claim 1, further comprising:

a base cover located above the base and defining at least a portion of the cooling flow path and at least a portion of the circulation flow path.

3. The clothes treating apparatus of claim 2, wherein the discharge opening is defined in the base cover.

4. The clothes treating apparatus of claim 3, further comprising:

a guide member defining the discharge opening and configured to guide cooling air discharged from the discharge opening.

5. The clothes treating apparatus of claim 4, wherein the guide member comprises:

a fastening portion fastened to an outer circumferential portion of the discharge opening; and a discharge guide portion configured to guide a direction in which cooling air is discharged from the discharge opening.

6. The clothes treating apparatus of claim 5, wherein the discharge guide portion directs cooling air discharged from the discharge opening toward the drum.

7. The clothes treating apparatus of claim 5, wherein the discharge guide portion directs cooling air discharged from the discharge opening along a surface of the base cover.

8. The clothes treating apparatus of claim 5, wherein the guide member includes a hook portion located at one end portion thereof and the base cover includes a hook coupling portion that is located proximate to the discharge opening and that is configured to couple to the hook portion of the guide member.

9. The clothes treating apparatus of claim 1, wherein a partial amount of cooling air which has passed through the condenser is discharged to the interior of the cabinet, and a remaining portion of cooling air is directly discharged to the outside of the cabinet.

10. The clothes treating apparatus of claim 9, further comprising an auxiliary discharge portion that communicates with the cooling flow path, that discharges the remaining portion of cooling air to the outside of the cabinet, and that is located at a front surface of the base.

11. A clothes treating apparatus comprising:

a cabinet;

a drum located within the cabinet and configured to rotate about a rotational shaft;

a circulation duct that defines a circulation flow path in which exhaust air discharged from the drum is re-supplied to the drum;

a condenser configured to allow the exhaust air and cooling air introduced from outside of the cabinet to be heat-exchanged;

a blowing duct configured to guide the cooling air toward the condenser;

a blowing fan configured to introduce air from outside of the cabinet to an interior of the blowing duct;

a discharge opening that discharges cooling air, which has passed through the condenser, to an interior of the cabinet; and a guide member defining the discharge opening and configured to guide cooling air discharged from the discharge opening, wherein the discharge opening discharges the cooling air toward the drum, and wherein the guide member comprises:

a fastening portion fastened to an outer circumferential portion of the discharge opening; and a discharge guide portion configured to guide a direction in which cooling air is discharged from the discharge opening.

12. The clothes treating apparatus of claim 11, wherein the condens er is located on a bottom surface of the cabinet.

13. The clothes treating apparatus of claim 11, wherein the cabinet includes an air vent for discharging, from the cabinet, cooling air discharged from the discharge opening into the cabinet.

14. The clothes treating apparatus of claim 11, wherein a partial amount of cooling air which has passed through the condenser is discharged to the interior of the cabinet through the discharge opening, and a remaining amount of cooling air is directly discharged to the outside of the cabinet.

15. The clothes treating apparatus of claim 11, wherein the discharge guide portion directs cooling air discharged from the discharge opening toward the drum.

16. The clothes treating apparatus of claim 11, wherein the discharge guide portion directs cooling air discharged from the discharge opening perpendicular to the rotational shaft of the drum at a bottom of the drum.

17. The clothes treating apparatus of claim 11, wherein the guide member includes a hook portion located at one end portion thereof, the hook portion coupling to a hook coupling portion that is located proximate to the discharge opening.

18. The clothes treating apparatus of claim 11, wherein the rotational shaft of the drum is disposed between the discharge opening and the blowing fan.

* * * * *